US006354871B1

(12) United States Patent
Hatakeyama

(10) Patent No.: US 6,354,871 B1
(45) Date of Patent: Mar. 12, 2002

(54) CONNECTOR-MOUNTED SUBSTRATE AND METHOD FOR ASSEMBLING THE SAME

(75) Inventor: Kenichi Hatakeyama, Iwate (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/267,680

(22) Filed: Mar. 15, 1999

(30) Foreign Application Priority Data

Mar. 16, 1998 (JP) ..... 10-065528

(51) Int. Cl.[7] ..... H01R 13/73
(52) U.S. Cl. ..... 439/573; 439/569; 439/571
(58) Field of Search ..... 439/571, 563, 439/564, 569, 572; 411/182, 508, 509; 29/825

(56) References Cited

U.S. PATENT DOCUMENTS 4,688,317 A * 8/1987 Matuschek ..... 29/509
5,083,926 A * 1/1992 Kissinger et al. ..... 439/78

FOREIGN PATENT DOCUMENTS

| | | |
|---|---|---|
| JP | 5-26314 | 4/1993 |
| JP | 5-217613 | 8/1993 |
| JP | 8-162187 | 6/1996 |

* cited by examiner

*Primary Examiner*—Gary Paumen
*Assistant Examiner*—Ann McCamey
(74) *Attorney, Agent, or Firm*—Young & Thompson

(57) ABSTRACT

A method of surface-mounting a connector on a circuit board using a rivet as a mounting member is provided. This method can provide an excellent assembling process by, if necessary, using the conventional solder dipping process or rivet caulking process. A rivet has a middle portion acting as a flange. In the rivet, one end is previously fixed to a connector side while the other end is inserted into a first hole formed in the surface of a circuit board, so that the flange can be closely attached to the circuit board. Particularly, since a soldering pad is formed adjacent to a hole formed in the circuit board, the rivet can be bonded to the circuit board while other electronic components are being surface-soldered on the circuit board.

14 Claims, 6 Drawing Sheets

(A)

CONNECTOR-MOUNTED SUBSTRATE AND METHOD FOR ASSEMBLING THE SAME

BACKGROUND OF THE INVENTION

The present invention relates to a connector-mounted substrate and a method for assembling the same. Particularly, the present invention relates to an improved connector-mounted structure in which a connector is connected with a circuit board using specially-designed rivets and an improved method for assembling the same.

In the conventional connector-mounted substrate disclosed in, for example, JP-A-61773/1992, rivets of which one ends have flanges are inserted into through holes formed in common in a connector and a circuit board and are securely caulked.

However, the above-mentioned prior art has the drawback in that the rivets cannot be handled with the surface mounting technology such as the soldering flow technology and that components other than the connector to be mounted on a circuit board must be mounted in a different process.

The conventional rivet is intended for the purpose of the caulking process only but lacks general versatility. The conventional rivet fixing method provides the poor reliability because of variations in dimension of the through hole. Moreover, addition of the engaging member proposed in the above-mentioned patent publication causes an increase in the number of constituent components.

SUMMARY OF THE INVENTION

The present invention is made to solve the abovementioned problems.

Moreover, the objective of the invention is to provide connector-mounted board using general-purpose rivets with improved shapes.

Furthermore, the objective of the present invention is to provide a circuit board assembling method for assembling a connector to a circuit board using improved rivets.

The objective of the present invention is achieved by a connector-mounted board using rivets each having a middle portion acting as a flange. The upper surface of the flange is closely fixed to a connector while the back surface thereof closely fixed to a circuit board.

For example, in a connector-mounted board where a connector with plural contact pins is attached to a circuit board with rivets, each of the rivets has one end fixed to the connector and the other end inserted into a first hole formed in the circuit board. The middle portion of the rivet has a flange securely fixed to the circuit board.

A land to be solder-bonded is preferably formed in the vicinity of the first hole formed in the surface of a circuit board so as to confront the flange. The land is solder-bonded to the flange. One advantage of the invention is that the solder bonding can be performed while other electronic components are being solder-bonded on the circuit board.

Moreover, according to the present invention, the connector-to-circuit board assembling method, wherein a connector with plural contact pins is mounted on a circuit board, comprises the steps of previously fixing one end of the rivet with a middle portion acting as a flange to the connector, inserting the other end of the rivet into a first hole formed in the surface of the circuit board, and then securely fixing said rivet to the circuit board by bonding said flange to said circuit board.

Particularly, according to the present invention, the rivet is formed of a hollow sleeve having a slit fitted and mechanically fixed to a hole formed in a circuit board and a flange having a flat portion. The rivet is attached to the substrate mounting portion of a housing by inserting one sleeve of the rivet into the hole formed in the substrate mounting portion and then caulking the sleeve. A connector is mounted to a circuit board by printing a soldering paste on the flat portion of the rivet and on the connector fixing pad formed on the circuit board and then by heating the intermediate structure.

In addition to the method of fixing the flat portion to the connector fixing pad, there are a method of inserting a hollow sleeve with a slit of a rivet into a hole formed in a circuit board, then supplying solder in the vicinity of the hollow sleeve from the back surface of the circuit board, and solder-bonding the follow sleeve to the substrate hole and to the other connector fixing pad formed on the back surface of the circuit board, and a method of inserting a hollow sleeve with a slit of a rivet into a hole formed in a circuit board, then caulking the hollow sleeve of the rivet on the back surface of the circuit board. The same connector can be mounted on a circuit board by performing one fixing method or selectively combining at least two of the above-mentioned three fixing methods according to mounting requirements, so that the versatility is improved.

BRIEF DESCRIPTION OF THE INVENTION

This and other objects, features, and advantages of the present invention will become more apparent upon a reading of the following detailed description and drawings, in which.

DESCRIPTION OF THE EMBODIMENTS

Embodiments of the present invention will be described below with reference to the attached drawings.

Figure 1:
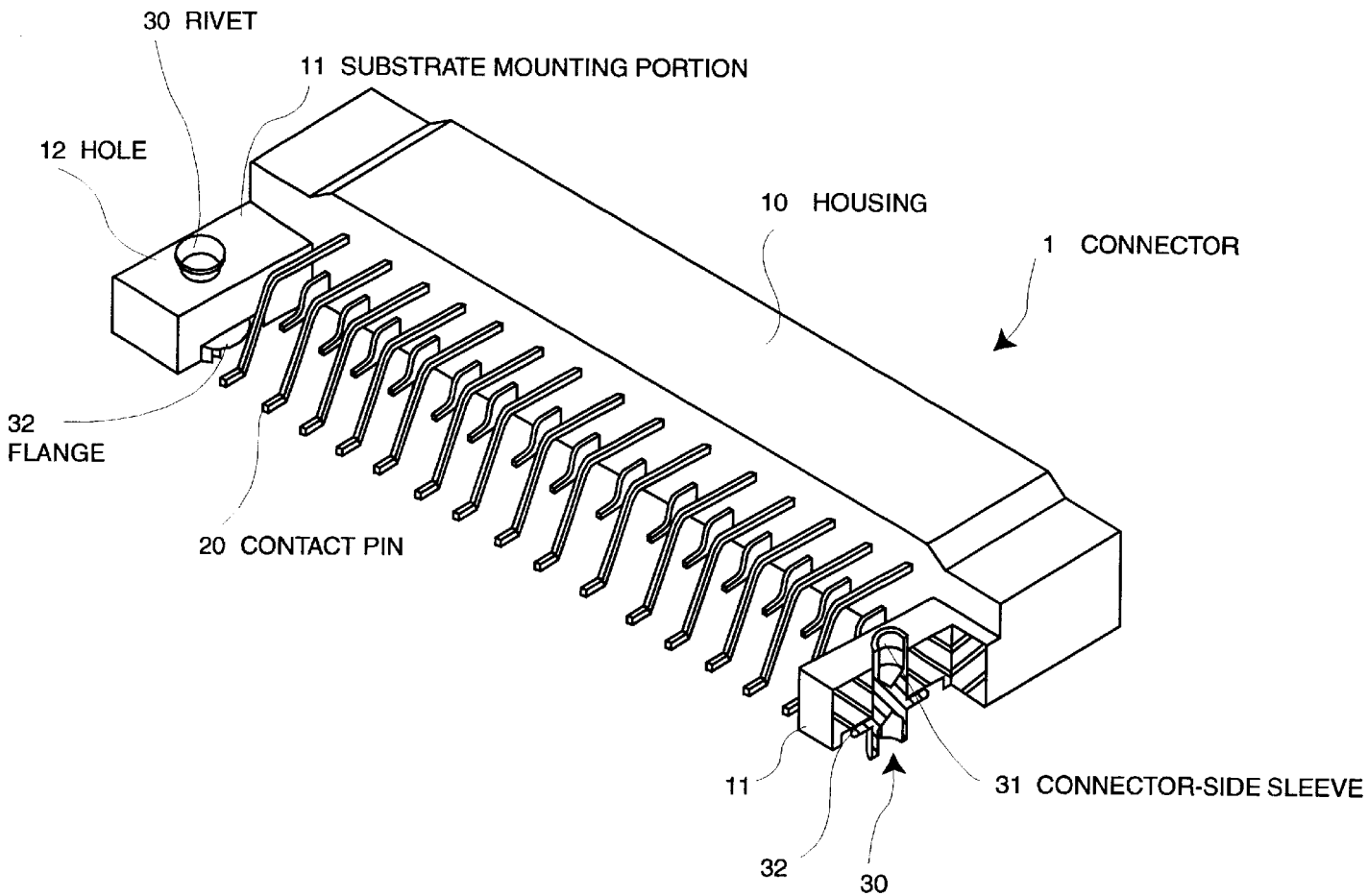
FIG. 1 is a perspective view illustrating a connector with rivets according to an embodiment of the present invention.
Figure 2:
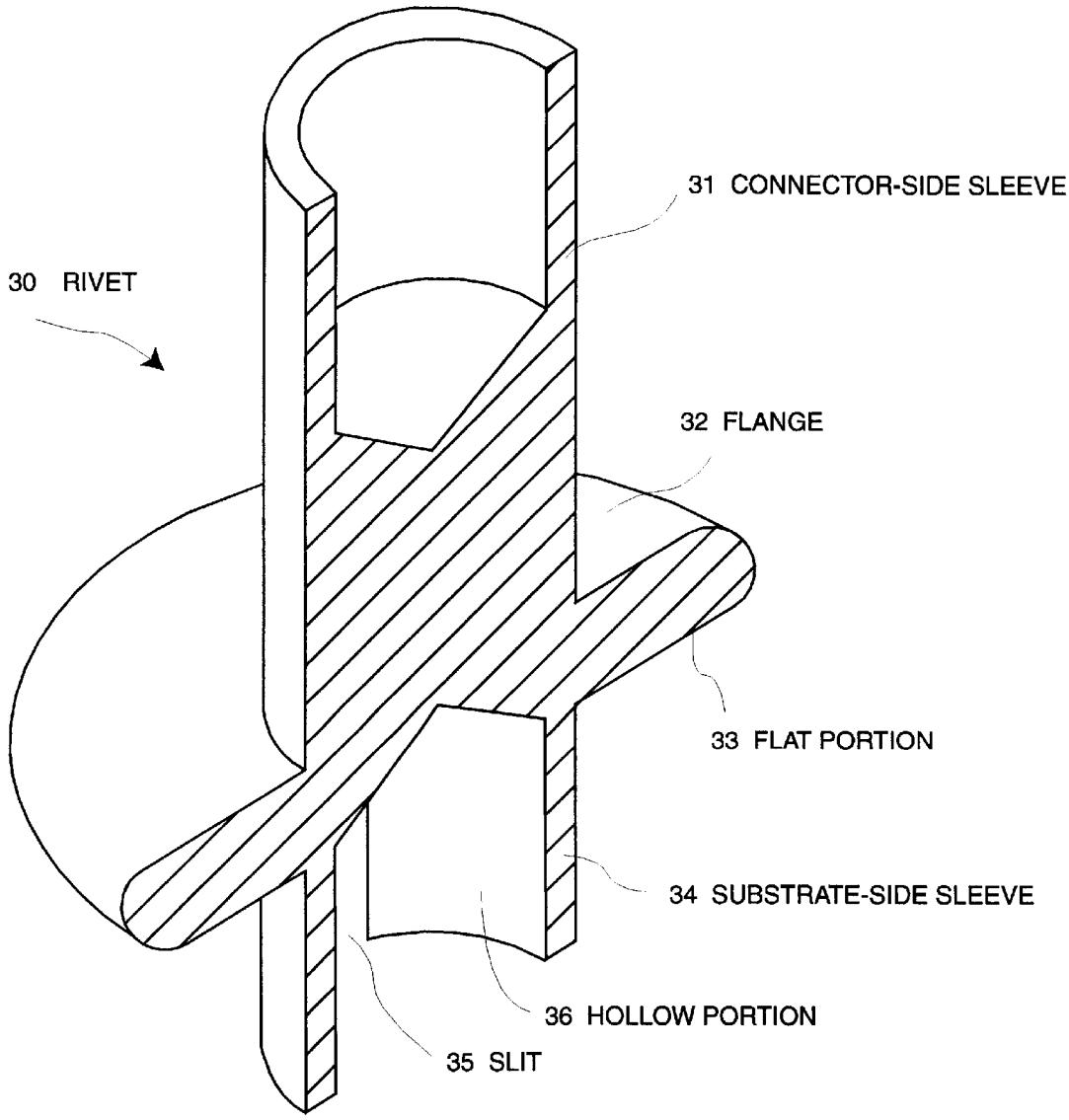
FIG. 2 is a perspective cross sectional view illustrating an enlargement of the rivet shown in FIG. 1.

FIG. 1 shows a connector 1 embodying the rivets 30 according to an embodiment of the present invention. The rivet 30, enlarged as shown in FIG. 2, has its middle portion acting as a flange 32 to be fixed to one end of a substrate-mounting portion 11 of the connector 1. The housing 10 of the connector 1 has one end surface on which plural contact pins 20 are forcedly planted in two lines and the opposite end surface (not shown) in which plural terminal outlets are formed corresponding to the contact pins. As shown in FIG. 1, the connector 1 has a pair substrate mounting portions 11 protruding in the same direction as that of the connect pins 20. The connector side sleeve 31 of the rivet 30 is inserted into the through hole 12 formed in each mounting portion 11 and is caulked thereat.

FIG. 2 shows in detail the rivet 30 previously mounted to the connector 1. Either side of the flange 33 has a flat portion 33. The connector side sleeve 31 extends from one flat portion 34 while the substrate side sleeve 34 extends from the other flat portion 33. The substrate side sleeve 34 has a hollow portion 36 and a slit 35. A hollow portion for facilitating the caulking operation, as shown in FIG. 2, is formed on the upper portion of the connector side sleeve 31.

Figure 3:
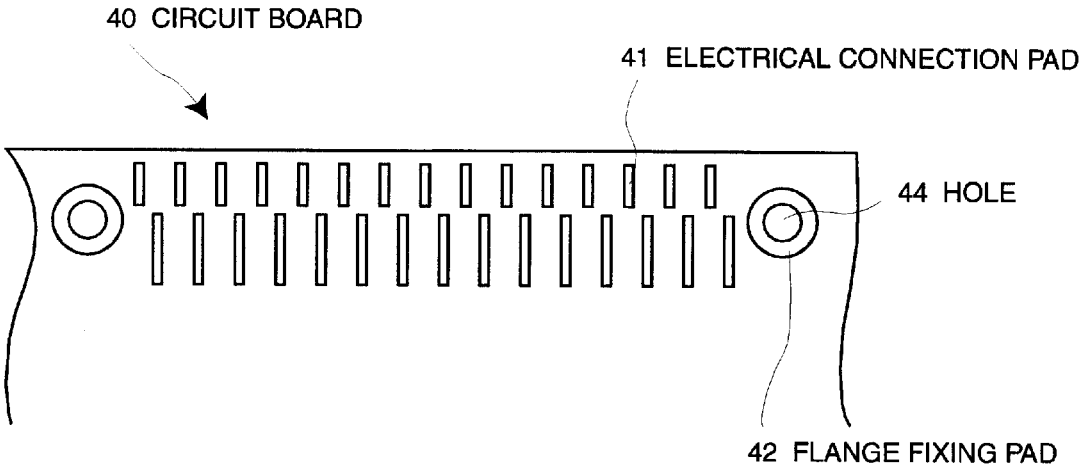
FIG. 3(A) is a front view partially illustrating the front surface of a circuit board on which a connector is to be mounted.
FIG. 3(B) is a diagram partially illustrating the back surface of the circuit board of FIG. 3(A)
Figure 3:
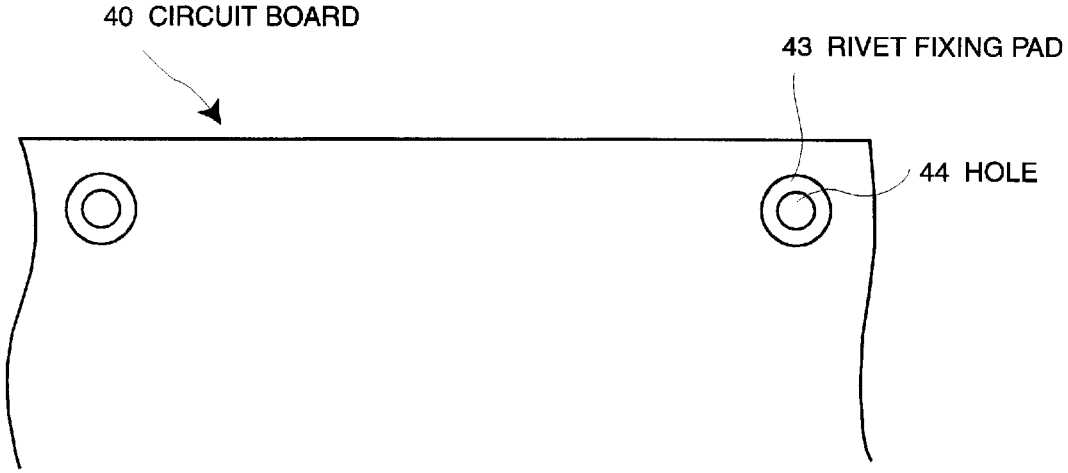

FIG. 3 shows the circuit board 40 on which the connector 1 shown in FIG. 1 is to be mounted. FIG. 3(A) partially shows the circuit board 40 having its surface to surface-mount electronic components and the connector 1. FIG. 3(B) partially shows the back surface of the circuit board 40. Pads 41 to be electrically connected with the contact pins 20 as well as flange fixing pads 42 for fixing the connector 1 by soldering the flange of the rivet 30 are formed on the surface of the circuit board 40. The pads 41 are respectively connected to wiring conductors (not shown) to establish electrical connections to electronic component mounting pads. Rivet fixing pads 43 are formed on the back surface of the circuit board 40 to solder-bond to the substrate side sleeve 34 of the rivet 30.

The pads 41, 42 and 43 are formed of a metal, which can be subjected to soldering. For example, the pads are formed by patterning a copper film, as being generally used in the conventional circuit board fabricating process. Holes 44 penetrating the circuit board 40 are formed and the inner surface thereof are plated with copper. That is, The pads 42 and 43 and the hole 44 define a through hole with lands to the circuit board.

Figure 4:
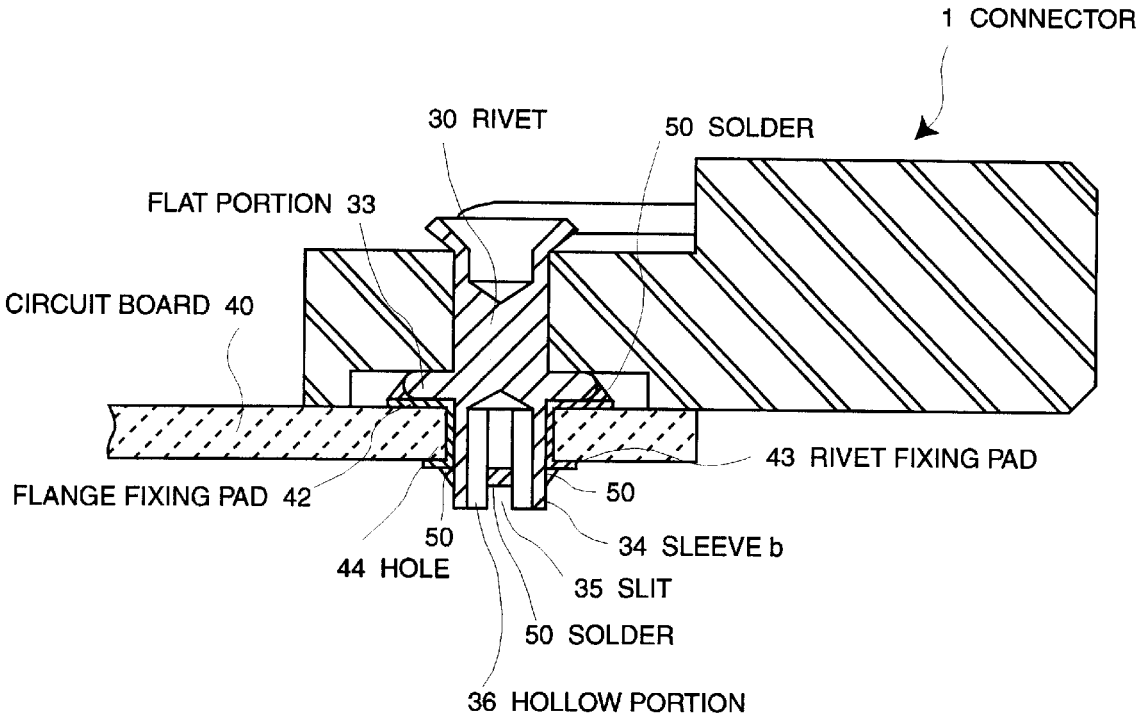
FIG. 4 is a cross sectional view partially illustrating the structure in which the connector of the present embodiment shown in FIG. 1 is assembled to the circuit board shown in FIG. 3.

FIG. 4 shows how to mount the connector 1 of FIG. 1 on the circuit board 40 of FIG. 3. A method of assembling a connector to the circuit board will be described here by referring to FIGS. 3 and 4. The contact pins 20 are soldered to the pads 41, in the well-known manner. This soldering process can be advantageously performed while the connector is being soldered to the circuit board.

At a preparing step, a soldering paste is printed to the flange fixing pads 42 shown in FIG. 3. At the same time, it is desirable to print the soldering paste to the electrical connection pads 41 and electronic component mounting pads (not shown). Next, as shown in FIG. 4, the connector is temporarily mounted to the circuit board 40 by inserting the substrate side sleeves 34 of the rivets 30 previously attached to the connector 1 into the holes 44. The entire intermediate structure is heated to solder-bond the flange fixing pads 42 to the flat portions of the rivets 30. Thus, the connector can be mounted to the circuit board, together with other electronic components.

In this embodiment, after the solder-fixing step, the molten solder 50 is supplied from the back surface of the circuit board 40 in the vicinity of the substrate side sleeve 34 of the rivet 30. The solder 50 invades into the hole 44 via the hollow portion 36 and the slit 35. The substrate side sleeve 34 of the rivet 30 is soldered to the rivet-fixing pad 43. Thus, the connector can be attached more rigidly to the circuit board.

The back surface soldering process called the back dipping is suitable for the operation of inserting leads of an electronic component into the mounting holes of the circuit board and then soldering the back surface of the circuit board. The back soldering process can be performed using rivets with no slits 35. However, it is desirable to use rivets with slits to improve the reliability of the back surface soldering work. Moreover, in addition to an improvement of the reliability of the back soldering process, the rivet with slits can effectively absorb the loose fitting (e.g. in the case of the diameter of a rivet>the diameter of an insertion hole). Thus, a high positional precision can be secured by minimizing the tolerance between the sleeve and the hole.

Figure 5:
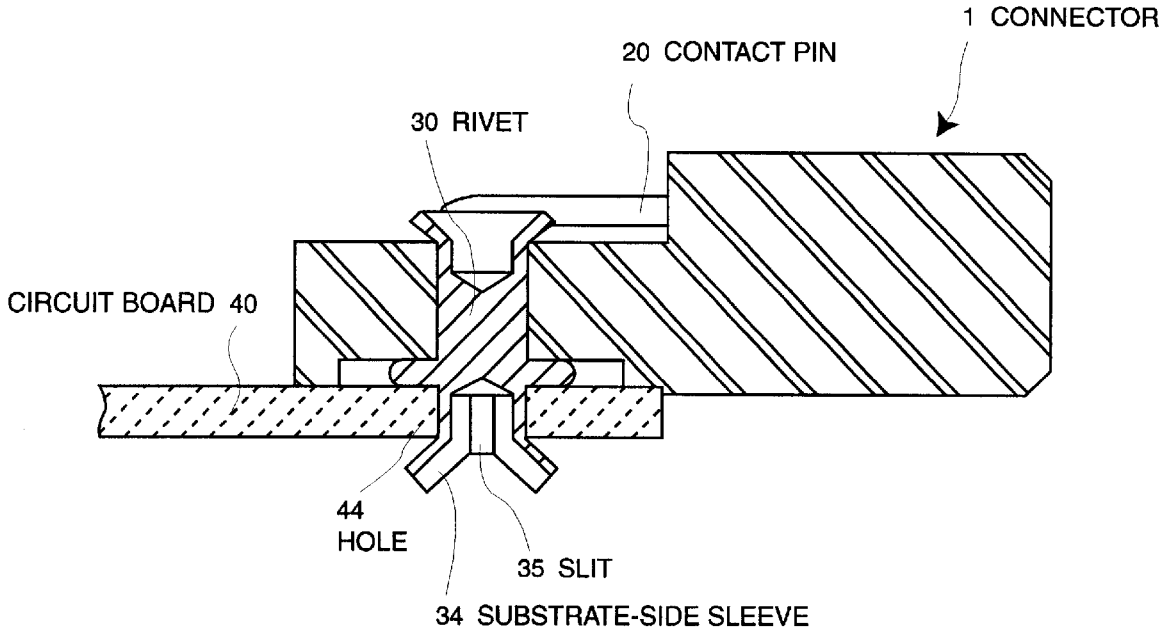
FIG. 5 is a cross sectional view partially illustrating the structure in which a connector according to another embodiment of the present invention is assembled to a circuit board.

FIG. 5 shows another embodiment of mounting the connector of FIG. 1 to the circuit board.

The connector 1 can be mounted to the circuit board 40 by inserting the substrate side sleeve 34 of the rivet 30 previously attached to the connector 1 into the hole 44 of the circuit board 40 and then caulking the substrate side sleeve 34 on the back surface of the circuit board 40.

Three fixing methods have been represented including (1) a method of soldering the flange fixing pad 42 to the flat portion 33, (2) a method of soldering the substrate side sleeve 34 to the rivet fixing pad 43 and the hole 44, and (3) a method of caulking the substrate side sleeve 34. The connector fixing process can be performed by using one of the three fixing methods. Plural fixing methods may be combined to fix the connector to the circuit board.

Even if the circuit board 40 does not have the hole 44 with copper plated inner surface formed in the circuit board 40 and even if the flange fixing pad 42 or the rivet fixing pad 43 is not used, the connector can be fitted to the circuit board by selectively combining the above-mentioned fixing methods.

Figure 6:
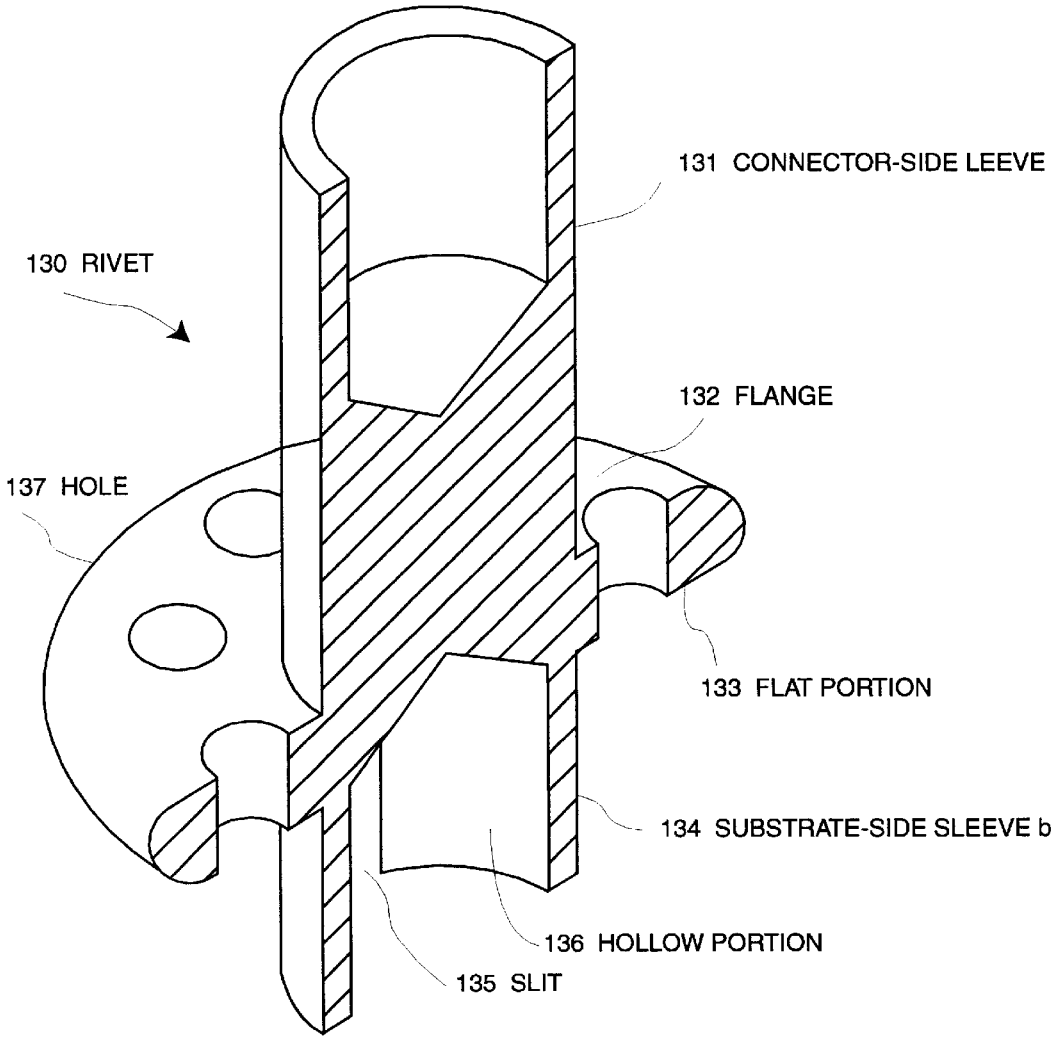
FIG. 6 is an enlarged perspective cross sectional view illustrating a rivet according to another embodiment of the present invention.

FIG. 6 shows a rivet used to the connector in FIG. 1, according to another embodiment of the present invention.

The rivet 130 is formed of a flange 132 having the flat portion 133 and holes 137, a connector side sleeve 131 extending from one side of the flange 132, and a substrate side sleeve 134 extending from the other side of the flange 132. The substrate side sleeve 134 has a hollow portion 136 and a slit 135.

The connector can be attached in a similar manner to that in the foregoing embodiment. That is, as shown in FIGS. 4 and 5, the connector is mounted to the circuit board by selecting at least one of three fixing methods: (1) solder-bonding the flange fixing pad 42 to the flat portion 33, (2) solder-bonding the substrate side sleeve 34 to the rivet fixing pad 43 and the hole 44, and (3) caulking the substrate side sleeve 34. The hole 137 allows the soldering strength to be become stronger.

However, the rivet of the present invention is not limited only to the embodiments shown in the attached drawings. The rivet may have no slit or no hollow. It is unnecessary to protrude the substrate side sleeve sufficiently from the back surface of the circuit board. The substrate side sleeve may be shortened in the caulking operation. The sleeve can be shortened to the extent that sufficient soldering can be secured on the back surface of a circuit board.

It is preferable that the outer diameter of the rivet-fixing pad is larger than that of the flange, in consideration to the soldering strength. The pad may be small-sized because the flange is butted on the back surface of the circuit board.

The rivet is preferably formed of a metal such as brass, which can be soldered or be easily caulked. The rivet may be formed by machining brass or other material and then plating the surface of the intermediate structure with nickel or solder to make the soldering process easy.

As described above, the present invention can handle the connector as a surface-mounting component. The surface mounting component apparatus can be effectively used without preparing the connector-only mounting apparatus.

In the fixing method, since at least one hole formed in the flange exposes the connector fixing pad and the soldering paste, the soldering properties to the solder-bonding portions can be improved.

Where a mounting component, except the connector, is not suited for the surface mounting process, the solder is fed to the vicinity of the rivet from the back surface of the circuit board after the rivets of the present invention are fitted to holes formed in the circuit board. Thus, the hollow and the slit allow the sleeve of the rivet to be soldered to the rivet-fixing pad on the back surface of the substrate and to the holes formed therein.

Furthermore, when a mounting condition does not allow the soldering process, the present invention can effectively adopt only the caulking process.

When a mounting condition requires a high soldering strength, at least two methods can be selected from three fixing methods (1) solder-bonding a flange to the surface of a circuit board, (2) solder-bonding a rivet to the back surface of a circuit board, and (3) caulking a rivet on the back surface of a circuit board.

In addition to the above-mentioned connector fixing methods, the connector can be positioned to a circuit board by fitting the round sleeve of a rivet to the round hole in the circuit board so that positional variations horizontally shifted to the board surface can be limited within the fitting tolerance. The connector can be effectively attached to the circuit board with high precision by decreasing the fitting tolerance.

The entire disclosure of Japanese Application No. 10-065528 filed Mar. 16, 1998 including specification, claims, drawing and summary are incorporated herein by reference in its entirely.

What is claimed is:

1. A connector mounted on a board, comprising:

a connector having a plurality of contact pins; and a circuit board on which said connector is mounted with rivets;

each of said rivets having one end fixed to said connector and the other end inserted into a first hole formed in said circuit board;

each of said rivets having a portion between said connector and said circuit board at which a flange is formed and securely fixed to said circuit board, wherein said first hole has a land therearound on a surface of said circuit board opposite a surface to which said connector is mounted, said land being made of a material that can be solder-bonded, and wherein said other end is solder-bonded to said land.

2. The connector mounted on a board defined in claim 1, wherein an inner surface of said first hole has a layer which can be solder-bonded, said inner surface being solder-bonded to said other end of said rivet.

3. The connector mounted board defined in claim 1, wherein said connector has a second hole through which one end of said rivet is inserted, one end of said rivet being caulked to said connector.

4. The connector mounted on a board defined in claim 1, wherein said first hole passes through said circuit board, the other end of said rivet being securely caulked to said circuit board.

5. The connector mounted on a board defined in claim 1, wherein the other end of said rivet h as a slit.

6. The connector mounted on a board defined in claim 1, wherein a distance between the other end of said rivet and said flange is larger than the thickness of said circuit board.

7. The connector mounted on a board defined in claim 1, wherein both ends of said rivet have hollow portions which can facilitate deformation by caulking.

8. The connector mounted on a board defined in claim 1, wherein an outer diameter of said rivet is substantially the same as an inner diameter of said first hole so that the other end of said rivet can be inserted into said first hole without wobbling.

9. A connector mounted on a board, comprising:

a connector having a plurality of contact pins; and a circuit board on which said connector is mounted with rivets;

each of said rivets having one end fixed to said connector and the other end inserted into a first hole formed in said circuit board;

each of said rivets having a portion between said connector and said circuit board at which a flange is formed and securely fixed to said circuit board, wherein said first hole has a land therearound on a surface of said circuit board opposite a surface to which said connector is mounted, said land being made of a material that can be solder-bonded, and wherein said other end is solder-bonded to said land, wherein said flange has a plurality of through holes.

10. A connector mounted on a board, comprising:

a connector having a plurality of contact pins;

a circuit board on which said connector is mounted with at least one rivet, said circuit board having a first hole therein that receives said rivet, said first hole having a land therearound that is made of a material that can be solder-bonded;

said rivet comprising one end that is fixed to said connector, another end that is in said first hole and a flange in a middle portion of said rivet, said flange being solder-bonded to said land.

11. The connector mounted on a board defined in claim 10, wherein an outer diameter of said land is larger than that of said flange.

12. A connector mounted on a board, comprising:

a connector having a plurality of contact pins; and a circuit board on which said connector is mounted with rivets;

each of said rivets having one end fixed to said connector and the other end inserted into a first hole formed in said circuit board;

each of said rivets having a portion between said connector and said circuit board at which a flange is formed and securely fixed to said circuit board, wherein said first hole has a land therearound on a surface of said circuit board opposite a surface to which said connector is mounted, said land being made of a material that can be solder-bonded, and wherein said other end is solder-bonded to said land, wherein each of said rivets is a tube with hollow portions at both the one end and the other end thereof and with a block between said hollow portions so that each of said rivets forms an H in cross section.

13. A connector mounted on a board, comprising:

a connector having a plurality of contact pins;

a circuit board on which said connector is mounted with at least one rivet, said circuit board having a first hole therein that receives said rivet, said rivet comprising one end that is fixed to said connector, another end that is in said first hole and a flange in a middle portion of said rivet, the another end of said rivet having a slit that extends to a distal end of the another end to form at least two arcuate sections, wherein said two arcuate sections are separated from each other to be wider than a diameter of said first hole.

14. A connector mounted on a board, comprising:

a connector having a plurality of contact pins;

a circuit board on which said connector is mounted with at least one rivet, said circuit board having a first hole therein that receives said rivet, said rivet comprising one end that is fixed to said connector, another end that is in said first hole and a flange in a middle portion of said rivet, the another end of said rivet having a slit that extends to a distal end of the another end to form at least two arcuate sections, wherein said first hole has a land therearound on a surface of said circuit board opposite a surface to which said connector is mounted, said land being made of a material that can be solder-bonded, and wherein said two arcuate sections are solder-bonded to said land.

* * * * *